US006432292B1

(12) United States Patent
Pinto et al.

(10) Patent No.: US 6,432,292 B1
(45) Date of Patent: Aug. 13, 2002

(54) METHOD OF ELECTRODEPOSITING METAL ON ELECTRICALLY CONDUCTING PARTICLES

(75) Inventors: Martin Pinto, Carlsbad; Stuart Smedley, Escondido; Jeffrey A. Colborn, Cardiff-by-the-Sea; James W. Evans, Piedmont, all of CA (US)

(73) Assignee: Metallic Power, Inc., Carlsbad, CA (US)

( * ) Notice: Subject to any disclaimer, the term of this patent is extended or adjusted under 35 U.S.C. 154(b) by 0 days.

(21) Appl. No.: 09/573,438

(22) Filed: May 16, 2000

(51) Int. Cl.[7] ..... C25D 7/00
(52) U.S. Cl. ..... 205/145; 205/144; 205/149
(58) Field of Search ..... 205/137, 144, 205/145, 149

(56) References Cited

U.S. PATENT DOCUMENTS

| | | | | |
|---|---|---|---|---|
| 3,663,298 A | | 5/1972 | McCoy et al. | 136/31 |
| 3,811,952 A | | 5/1974 | Siwersson et al. | 136/86 |
| 3,847,671 A | | 11/1974 | Leparulo et al. | 136/86 |
| 3,902,918 A | | 9/1975 | Pompon | 136/86 |
| 3,970,472 A | | 7/1976 | Steffensen | 136/3 |
| 3,981,747 A | | 9/1976 | Doniat et al. | 429/15 |
| 3,985,581 A | | 10/1976 | Stachurski et al. | 429/51 |
| 4,019,968 A | * | 4/1977 | Spaziante et al. | 205/144 |
| 4,090,927 A | * | 5/1978 | Fresnel et al. | 205/145 |
| 4,172,924 A | | 10/1979 | Warszawski | 429/15 |
| 4,182,383 A | | 1/1980 | Adomitis et al. | 141/5 |
| 4,198,475 A | | 4/1980 | Zaromb | 429/15 |
| 4,218,521 A | | 8/1980 | Putt et al. | 429/39 |
| 4,272,333 A | * | 6/1981 | Scott et al. | 205/144 |
| 4,287,273 A | | 9/1981 | Harney et al. | 429/153 |
| 4,730,153 A | | 3/1988 | Breting et al. | 320/14 |
| 4,842,963 A | | 6/1989 | Ross, Jr. | 429/21 |

(List continued on next page.)

FOREIGN PATENT DOCUMENTS

| | | | |
|---|---|---|---|
| FR | 2639767 | 6/1990 | |
| FR | 2669775 | 5/1992 | |
| JP | 51-49439 | 10/1974 | 429/70 |

OTHER PUBLICATIONS

R. F. Ross, Electroplating Miniature Balls. IBM Technical Disclosure Bulletin, vol. 5, No. 9, pp. 3, Feb. 1963.*

Cooper et al., Demonstration of a Zinc/Air Fuel Battery to Enhance the Range and Mission of Fleet Electric Vehicles; LLNL Reprint, Paper No. AIAA; 94–3841; 8 pages, Aug. 8, 1994.

Cooper et al., A Refuelable Zinc/Air Battery for Fleet Electric Vehicle Propulsion, SAE International, Paper No. 951948; Aug. 7–10, 1995.

Unknown Author, How the Zinc/Air Battery is Refueling the Competitiveness of Electric Vehicles, LLNL Publication, Science & Technology Review, Oct., 1995 pp. 7–13.

*Primary Examiner*—Donald R. Valentine
*Assistant Examiner*—William T. Leader
(74) *Attorney, Agent, or Firm*—Howrey Simon Arnold & White LLP

(57) ABSTRACT

The present invention relates to a device and method for electrolytic deposition of metals on conducting particles. The conducting particles are completely immersed in a liquid and allowed to flow across a particle contacting surface of a cathode support. The particles flow across the surface and into a reservoir. Electrical contact is made between the negative pole of a DC power supply and the conducting particles. An anode mesh is placed above and parallel to the top face of the particle bed such that the mesh does not touch the particle bed but remains a controlled distance from it. The anode mesh is connected to the positive terminal of the DC power supply. A significant aspect of the present invention is that the device does not require a separator between the particle bed and the anode.

34 Claims, 8 Drawing Sheets

U.S. PATENT DOCUMENTS

| | | | | | |
|---|---|---|---|---|---|
| 5,006,424 | A | | 4/1991 | Evans et al. | 429/15 |
| 5,168,905 | A | | 12/1992 | Phallen | 141/1 |
| 5,188,911 | A | | 2/1993 | Downing et al. | 429/70 |
| 5,196,275 | A | | 3/1993 | Goldman et al. | 429/27 |
| 5,318,861 | A | | 6/1994 | Harats et al. | 429/21 |
| 5,360,680 | A | | 11/1994 | Goldman et al. | 429/27 |
| 5,378,329 | A | | 1/1995 | Goldstein et al. | 204/115 |
| 5,434,020 | A | | 7/1995 | Cooper | 429/210 |
| 5,441,820 | A | | 8/1995 | Siu et al. | 429/17 |
| 5,558,947 | A | | 9/1996 | Robison | 429/13 |
| 5,569,551 | A | | 10/1996 | Pedicini et al. | 429/27 |
| 5,578,183 | A | | 11/1996 | Cooper | 205/64 |
| 5,603,815 | A | * | 2/1997 | Lashmore et al. | 204/222 |
| 5,635,051 | A | | 6/1997 | Morales et al. | 205/602 |
| 5,849,427 | A | | 12/1998 | Siu et al. | 429/19 |
| 5,869,200 | A | | 2/1999 | Nunnally | 429/10 |
| 5,958,210 | A | * | 9/1999 | Siu et al. | 205/602 |
| 6,086,733 | A | | 7/2000 | Carey et al. | 204/242 |

* cited by examiner

METHOD OF ELECTRODEPOSITING METAL ON ELECTRICALLY CONDUCTING PARTICLES

RELATED PATENT APPLICATIONS AND PATENTS

This application is related to U.S. Pat. No. 5,952,117 and U.S. patent application Ser. Nos. 09/449,176; 09/521,392; and 09/353,422, all of which are owned in common by the assignee hereof, and all of which are fully incorporated by reference herein as though set forth in full.

BACKGROUND OF THE INVENTION

1. Field of the Invention

The present invention relates, in general, to an apparatus and method for performing an electrochemical process on electrically conductive particles, and, in particular, to an electrolyzer and method for electrodeposition on electrically conducting particles.

2. Related Art

One of the more promising alternatives to conventional power sources in existence today is the metal/air fuel cell. These fuel cells have tremendous potential because they are efficient, environmentally safe and completely renewable. Metal/air fuel cells can be used for both stationary and motile applications, and are especially suitable for use in all types of electric vehicles.

Metal/air fuel cells and batteries produce electricity by electrochemically combining metal with oxygen from the air. Zinc, iron, lithium, and aluminum are some of the metals that can be used. Oxidants other than air, such as pure oxygen, bromine, or hydrogen peroxide can also be used. Zinc/air fuel cells and batteries produce electricity by the same electrochemical processes. But zinc/air fuel cells are not discarded like primary batteries. They are not slowly recharged like secondary batteries, nor are they rebuilt like "mechanically recharged" batteries. Instead, zinc/air fuel cells are conveniently refueled in minutes or seconds by adding additional zinc when necessary. Further, the zinc used to generate electricity is completely recoverable and reusable.

The zinc/air fuel cell is expected to displace lead-acid batteries where higher specific energies are required and/or rapid recharging is desired. Further, the zinc/air fuel cell is expected to displace internal combustion engines where zero emissions, quiet operation, and/or lower maintenance costs are important.

In one example embodiment, the zinc "fuel" is in the form of particles. Zinc is consumed and releases electrons to drive a load (the anodic part of the electrochemical process), and oxygen from ambient air accepts electrons from the load (the cathodic part). The overall chemical reaction produces zincate or its precipitate zinc oxide, a non-toxic white powder. When all or part of the zinc has been consumed and, hence, transformed into zincate or zinc oxide, the fuel cell can be refueled by removing the reaction product and adding fresh zinc particles and electrolyte.

The zincate or zinc oxide (ZnO) product is typically reprocessed into zinc particles and oxygen in a separate, stand-alone recycling unit using electrolysis. The whole processing a closed cycle for zinc and oxygen, which can be recycled indefinitely.

In general, a zinc/air fuel cell system comprises two principal components: the fuel cell itself and a zinc recovery apparatus. The recovery apparatus is generally stationary and serves to supply the fuel cell with zinc particles, remove the zinc oxide, and convert it back into zinc metal fuel particles. A metal recovery apparatus may also be used to recover zinc, copper, or other metals from solution for any other purpose. In particular, a metal recovery apparatus may be used to economically recover metals from scrap or from processed ore.

The benefits of zinc/air fuel cell technology over rechargeable batteries such as lead-acid batteries are numerous. These benefits include very high specific energies, high energy densities, and the de-coupling of energy and power densities. Further, these systems provide rapid on-site refueling that requires only a standard electrical supply at the recovery apparatus. Still further, these systems provide longer life potentials, and the availability of a reliable and accurate measure of remaining energy at all times.

The benefits over internal combustion engines include zero emissions, quiet operation, lower maintenance costs, and higher specific energies. When replacing lead-acid batteries, zinc/air fuel cells can be used to extend the range of a vehicle or reduce the weight for increased payload capability and/or enhanced performance. The zinc/air fuel cell gives vehicle designers additional flexibility to distribute weight for optimizing vehicle dynamics.

The benefits of using an electrolyzer with a moving particulate bed for metal recovery from processed ore or scrap include the following: 1) The energy consumption per unit of metal produced can be far lower than with traditional techniques; 2) The apparatus can be run continuously without periodic labor intensive shutdowns for removing recovered metal in slab form, as with traditional techniques; 3) The particulate form of the metal produced is much more convenient to store, distribute, ship, and use than are the metal slabs produced using traditional apparatus.

The recovery apparatus uses an electrolyzer to reprocess dissolved zinc oxide into zinc particles for eventual use in the fuel cells (or, in the case of a metal processing or recovery application, into metal particles that can be conveniently stored, shipped, and introduced into metal refining, casting, or fabrication processes). The electrolyzer accomplishes this by electrodepositing zinc from the zinc oxide on electrically conducting particles. Fluidized bed electrolyzers and spouted bed electrolyzers are examples of two types of technologies used for the electrodeposition of metals on conducting particles (see for example U.S. Pat. No. 5,695,629, Nadkami et al.; "Spouted Bed Electrowinning of Zinc: Part I, Juan Carlos Salas-Morales et al., Metall. Trans. B, 1997, vol. 28B, pp. 59–68; U.S. Pat. No. 4,272, 333, Scott et al.; and U.S. Pat. No. 5,958,210, Siu et al.). In both a fluidized bed electrolyzer and spouted bed electrolyzer, the anodes are separated from the fluidized particles by a separator. The separator must be an ionic conductor but not an electrical conductor and must be resistant to erosion and dendrite growth for the electrolyzer to perform reliably. The dendrite problem is particularly difficult to avoid since if a single conducting particle becomes trapped in or on the separator, and if the particle remains in electrical contact with the bed of moving particles, it will grow through the separator toward the anode and cause an electrical short. At this point, the electrolyzer may have to be disassembled and rebuilt with a new separator. Another problem with some electrolyzers is the low volumetric efficiency or low space time yield of the device. In other words, a device of a given size does not produce enough metal per unit time to be economically viable or practical. This results from the fact that In a conventional "plate" electrolyzer the cathode is a zinc plate, which has a much lower surface area on which electrodeposition can take place than does a bed of particles occupying a similar volume. Therefore the yield of electrodeposited material per unit volume may be very low in a conventional flat plate system.

A problem with a traditional fluidized bed electrolyzer is the high pumping energy required to maintain the cathode particle bed in fluid motion, thereby decreasing the overall efficiency of the system. Yet another disadvantage of the traditional fluidized bed electrolyzer is the poor average electrical contact made by the fluidized cathode particles with the current collector, further reducing the energy efficiency of the system.

Thus, what is needed is an electrolyzer for electrodeposition on electrically conductive particles that maintains good electrical contact between the power supply and the conducting particles, does not require unacceptably high pumping power, and eliminates the need for a separator, thereby avoiding the aforementioned problems with separator erosion through contact with the moving particles, and the growth of dendritic particles which penetrate the separator and cause an electrical short between the anode and cathode. The electrolyzer should also have a high yield of electrodeposited material per unit volume.

SUMMARY OF THE INVENTION

Accordingly, the present invention eliminates the need for a separator in an electrolyzer for electrodeposition on electrically conductive particles, thereby avoiding separator erosion problems and short circuit problems caused by dendritic particle growth. The invention also has a high yield of electrodeposited material per unit volume.

The present invention provides an electrolyzer for electrodeposition onto electrically conductive particles. In one embodiment, the electrolyzer includes a cathode support including an upper surface with at least one dimension inclined at an angle relative to horizontal sufficient to allow gravitational forces to cause a bed of the electrically conductive particles to flow at a substantially uniform density and flow rate down the upper surface. The flowing bed of particles is the cathode. The cathode support is preferably, but not necessarily, planar. An electrical contact is made with the cathode (the bed of particles) either by the cathode support or by some other means, where the electrical contact can be connected to an electrical power supply. The cathode support includes an upper portion at which the particles enter the cathode support surface and a lower portion at which the particles exit the cathode support surface. In one embodiment, an anode is spaced from the cathode, without a separator therebetween, a distance sufficiently small to minimize resistance to ionic current flow between the anode and the particles and yet sufficiently large to allow clearance for the bed of electrically conductive particles flowing down the cathode support surface without sustained contact with the anode. This distance should be between 1 and 50 times the average diameter of the conductive particles, and preferably between 1 and 10 times the average diameter of the conductive particles. A recirculation line communicates the lower end of the cathode with the upper end of the cathode. A pump is interconnected with the recirculation line and adapted to transfer fluidized particles at the lower portion of the cathode to the top of the cathode.

Multiple embodiments of the invention are possible, including constructions in which the cathode support is an inclined plate, a helical surface, a spiral surface, a spinning funnel-shaped element, and a vibrating plate, and in which the force causing particle movement on the cathode support is gravity, a frictional force created by vibration, a centrifugal force, or some other force. In the embodiment in which the cathode support is an inclined surface, the cathode support may be made of any material that can chemically withstand the fluidizing liquid electrolyte and the abrasive action of the moving particle bed, and the surface of the cathode support should have a sufficiently low coefficient of friction to ensure the particle bed does not stop flowing down the inclined dimension of the cathode support. The angle of the inclined surface needs to be sufficiently steep to ensure constant motion of the particle bed but sufficiently shallow to keep the particle bed as dense as possible. The best range of angles depends upon several factors, including the coefficient of friction of the cathode support, the density and viscosity of the electrolyte, and morphology of the particles, and the type of metal. For electrodeposition of zinc onto zinc cut wire particles approximately 0.75 mm in diameter in 35% potassium hydroxide solution at 50° C. with a 304 stainless steel cathode support with roughness $\epsilon/dp$ preferably being within the range $0 \leqq \epsilon/dp \leqq 10$, and optimally, within the range $0 \leqq \epsilon/dp \leqq 0.1$, acceptable angles were observed to be between about 10 and 45 degrees, with the best angles in the range of 20 to 25 degrees. In the foregoing, the parameter $\epsilon/dp$ is dimensionless, and comprises the ratio of $\epsilon$, the height of the roughness, and dp, the particle diameter. The anode generally has a mesh construction. The anode is preferably substantially flat and parallel with the cathode support if the cathode support is substantially flat. The anode is preferably planar and parallel to the surface of the cathode particle bed so as to minimize the distance between the anode and the cathode at all points. The anode is supported by a current collector, and for applications in which a gas such as oxygen may be evolved such as the reduction of metals from metal oxides, an oxygen escape region is generally located between the anode and the current collector. A feed control mechanism is generally located near the upper portion of the cathode, and the feed control mechanism is adapted to control the flow rate and density of the bed of electrically conductive particles flowing down the cathode support. A feed reservoir is adapted to hold a supply of the electrically conductive particles. A receiving reservoir, which is preferably but not necessarily distinct from the feed reservoir, is adapted to receive the electrically conductive particles after they flow down the inclined surface of the cathode. The recirculation line communicates the receiving reservoir with the feed reservoir. A fluid tank is adapted to hold fluid used to fluidize the electrically conductive particles. A fluid bleed line communicates the feed reservoir with the fluid tank. A fluid supply line communicates the fluid tank with the receiving reservoir.

An additional aspect of the invention involves a method of electrodepositing metal on electrically conductive particles. In one embodiment, the method includes providing an electrolyzer with a particulate cathode and a cathode support having an upper surface inclined at an angle relative to horizontal sufficient to allow gravitational forces to cause a bed of the electrically conductive particles to flow at a substantially uniform density and flow rate down the upper surface. One embodiment of the cathode support includes an upper portion at which the particles enter the cathode surface and a lower portion at which the particles exit the cathode support surface. An anode is spaced from the particulate cathode, without a separator therebetween, a distance sufficiently small to minimize resistance to ionic current flow between the anode and the particles and yet sufficiently large to allow clearance for the bed of electrically conductive particles flowing down the cathode support surface without significant contact with the anode. A recirculation line communicates the lower end of the cathode with the upper end of the cathode. A pump is interconnected with the recirculation line and adapted to transfer particles at the lower portion of the cathode to the top of the cathode. One embodiment of the method further includes supplying the electrolyzer with electrically conductive particles and a liquid electrolyte containing dissolved metal ions (simple or complex); allowing gravitational forces to cause the electrically conductive particles to flow at a substantially uniform density and flow rate down the upper surface; electrodepositing metal from the reaction product on the electrically conductive particles as the particles flow down the inclined surface of the cathode support by providing an electrical current between the anode and particulate cathode; and recirculating electrically conductive particles from the lower portion of the cathode to the upper portion of the cathode using the pump.

Embodiments of the aspect of the invention described immediately above may include one or more of the following: The cathode support includes a construction selected from the group consisting of an inclined plate, an inclined non-planar surface, a helical surface, a spiral surface, a vibrating surface, and a funnel-shaped rotating surface. In the embodiment in which the cathode support is an inclined surface, the cathode support may be made of any material that can chemically withstand the fluidizing liquid electrolyte and the abrasive action of the moving particle bed, and the surface of the cathode support should have a sufficiently low coefficient of friction to ensure the particle bed does not stop flowing down the inclined dimension of the cathode support. The angle B of the inclined surface from horizontal needs to be sufficiently steep to ensure constant motion of the particle bed but sufficiently shallow to keep the particle bed as dense as possible. The best range of angles are between 5 degrees and 75 degrees and depends upon several factors, including the coefficient of friction of the cathode support, the density and viscosity of the electrolyte, and the density and morphology of the particles. For electrodeposition of zinc onto zinc cut wire particles approximately 0.75 mm in diameter in 35% potassium hydroxide solution at 50° C. with a 304 stainless steel cathode support with a roughness $\epsilon/dp$ preferably falling within the range $0 \leqq \epsilon/dp \leqq 10$, and most preferably within the range $0 \leqq \epsilon/dp \leqq 0.1$, acceptable angles were observed to be between about 10 degrees and 45 degrees, with the best angles between about 20 degrees and 25 degrees. The anode generally has a mesh construction. The anode is preferably substantially flat and parallel with the cathode support if the cathode support is substantially flat. The anode is preferably planar and parallel to the surface of the cathode particle bed so as to minimize the distance between the anode and the cathode at all points. The anode is supported by a current collector, and for applications involving the reduction of metals from metal oxides, an oxygen escape region is generally located between the anode and the current collector, and the method further includes removing oxygen produced during electrodeposition from the oxygen escape region. A feed control mechanism is located near the upper portion of the cathode, the feed control mechanism is adapted to control the flow rate and density of the bed of electrically conductive particles flowing down the cathode, and the method further includes controlling the flow rate and density of the electrically conductive particles flowing down the cathode with the feed control mechanism. A feed reservoir is adapted to hold a supply of the electrically conductive particles, and the method includes supplying the electrolyzer with electrically conductive particles and a liquid electrolyte containing dissolved metal ions (simple or complex)at the feed reservoir. A receiving reservoir, which is preferably but not necessarily distinct from the feed reservoir, is adapted to receive the electrically conductive particles after they flow down the inclined surface of the cathode support. The recirculation line communicates the receiving reservoir with the feed reservoir, and the method includes recirculating electrically conductive particles from the receiving reservoir to the feed reservoir through the recirculation line. A fluid tank is adapted to hold fluid used to fluidize the electrically conductive particles. A fluid bleed line communicates the feed reservoir with the fluid tank, and the method further includes bleeding a portion of fluid supplied to the feed reservoir to the fluid tank using the fluid bleed line. A fluid supply line communicates the fluid tank with the receiving reservoir, and the method further includes supplying additional fluid to the receiving reservoir using the fluid supply line.

BRIEF DESCRIPTION OF THE FIGURES

The present invention is described with reference to the accompanying drawings, wherein.

In the figures, like reference numbers generally indicate identical, functionally similar, and/or structurally similar elements.

DETAILED DESCRIPTION OF THE PREFERRED EMBODIMENTS

All of the examples of the present invention presented herein are associated with an electrolyzer for electrodepositing zinc on electrically conductive zinc particles. It is important to note, however, that the present invention can be applied to any process for electrodeposition on electrically conducting particles or for any electrochemical process performed on conducting particles, such as, but not by way of limitation the electrowinning of copper, zinc, gold, silver, platinum, or electrophoretic painting of particles, or anodizing of aluminum particles, or performing electro-oxidation or reduction on a high surface area electrode where some form of self cleaning is beneficial to long term performance. For electrowinning of metals, the electrolyzer is operated with an electrolyte containing the dissolved metal, and the metal particles are made cathodic. Accordingly, the examples used herein for the electrodeposition of zinc should not be construed to limit the scope and breadth of the present invention. Further, although the flow medium is described herein as a electrolyte, in another implementation the flow medium may be a fluid, i.e., liquid or gas, other than an electrolyte.

Figure 1:
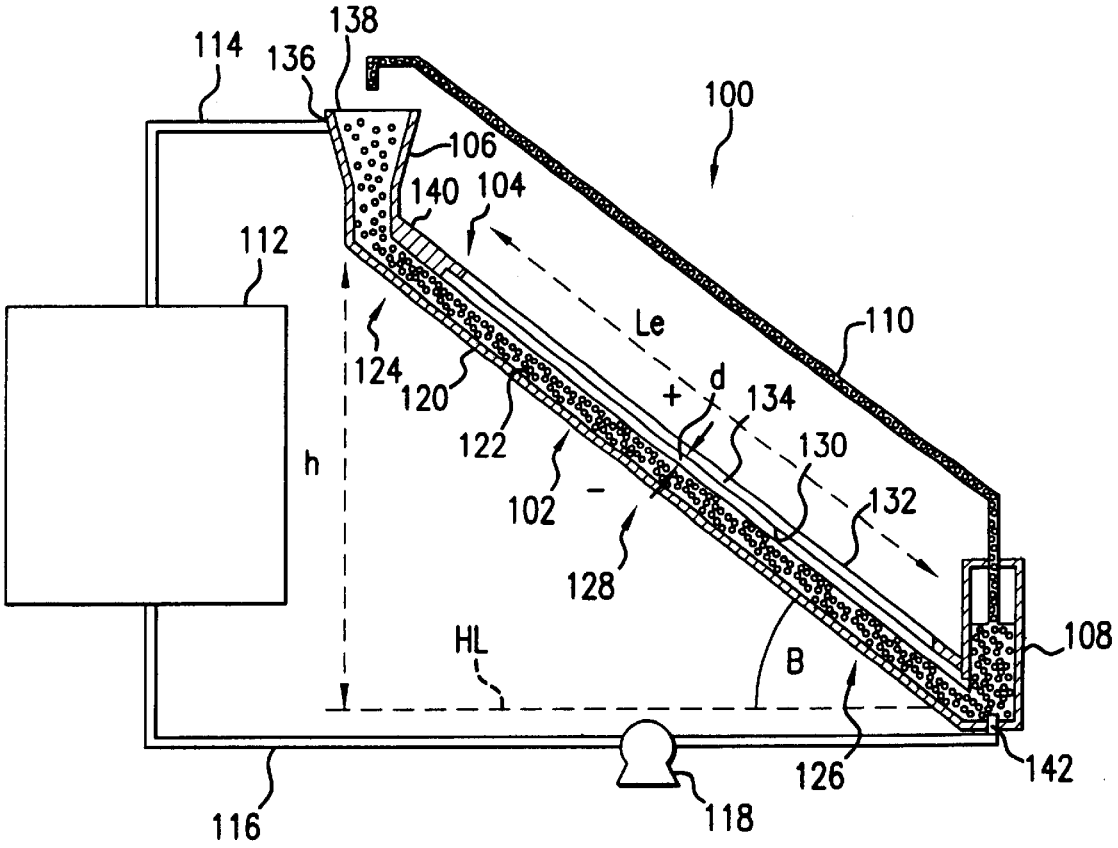
FIG. 1 is a schematic illustration of an embodiment of an electrolyzer for electrodeposition on electrically conductive particles.

With reference to FIG. 1, an electrolyzer 100 constructed in accordance with an embodiment of the invention will now be described. The electrolyzer 100 includes a cathode support 102, an anode 104, a feed reservoir 106, a receiving reservoir 108, a recirculation line 110 communicating the receiving reservoir 108 with the feed reservoir 106, an electrolyte fluid tank 112, a bleed line 114 communicating the feed reservoir 106 with the electrolyte fluid tank 112, a fluid supply line 116 communicating the fluid tank 112 with the receiving reservoir 108, and one or more pumps 118 located in the lines 110, 114, 116 for imparting a pumping action to the fluids in the electrolyzer 100.

The cathode support 102 illustrated in the embodiment of the invention shown in FIG. 1 is a flat plate 120 including an upper surface 122 defining a plane inclined at an angle B relative to an imaginary horizontal line HL. The cathode support 102 includes an upper portion 124, a lower portion 126 and an intermediate portion 128. In one implementation, the cathode support 102 includes a height h and a length $L_e$, where $h/L_e=\sin(B)$ . The flat plate 120 may be made of an electrically conducting material such as stainless steel and connected to the negative pole of a dc power supply (not shown). Although in the embodiment of the electrolyzer 100 shown in FIG. 1 the entire cathode support 102, i.e., flat plate 120, is shown inclined at an angle B relative to horizontal HL, in an alternative embodiment of the invention, cathode support 102 may be comprised of an upper surface inclined at an angle B supported by a conductive or non-conductive base that is not oriented at the angle B, e.g., the cathode is a layer of conductive metallic paint on a hypotenuse face of a non-conductive right triangular wedge. Thus, in one embodiment of the invention, it is the angle B of the upper surface 122 of the cathode support 102 that is important, not the angle or orientation of its base. In an alternative embodiment, the cathode support may be nonconducting and electronic contact may be made with the particulate cathode via conducting posts passing through the cathode support, with the posts being connected to the negative pole of a dc power supply (not shown). In another alternative embodiment, the electrical contact with the particle bed is made via metallic sidewalls connected to the cathode support. Many other methods are possible for making electrical contact with the cathode (the moving particle bed). The angle B of the upper surface 122 of the cathode support 102 is preferably such that a substantially uniform thickness of electrically conductive particles entrained in electrolyte flow at a substantially uniform rate down the upper surface 122 of the cathode. The top surface of the flowing conductive particles should generally define a plane parallel to the plane generally defined by the upper surface 122 of the cathode support plate 120. The bed of conductive particles preferably flow at a rate such that under the influence of an applied electric field, zinc will deposit on the moving charged particles and oxygen will be liberated on the anode 104, without cementation of the particles to the cathode support 102 or to each other. The angle B is in the range of 5 degrees to 75 degrees and is preferably in the range of 10 to 45 degrees under most conditions. In an alternative embodiment of the invention, the cathode support 102 may have a construction other than a flat plate such as, but not by way of limitation, a spiral, a helix or a double helix.

The anode 104 illustrated in the embodiment of the invention shown in FIG. 1 is an electronically conducting mesh 130 spaced above and substantially parallel to the cathode support plate 120 and top surface of the pellet bed. The anode mesh 130 is connected to and located a spaced distance below a supporting metal plate or current collector 132. The current collector 132 is connected to the positive terminal of the -de power supply (not shown). An oxygen escape region 134 is located between the anode mesh 130 and current collector 132. The anode mesh 130 is spaced a distance from the upper surface 122 of the cathode support plate 120 such that the anode mesh 130 does not touch the upper surface of the flowing particle bed cathode but remains a controlled distance d from it. The distance d between the anode mesh 130 and upper surface of the flowing pellet bed should be between 1 and 50 times the average diameter of the conductive particles, and preferably between 1 and 10 times the average diameter of the conductive particles. For electrodeposition of zinc onto zinc cut wire particles approximately 0.75 mm in diameter in 35% potassium hydroxide solution at 50° C. with a 304 stainless steel cathode support with a roughness, s/dp, preferably within the range $0 \leqq \delta/dp \leqq 10$, and most preferably in the range $0 \leqq \epsilon/dp \leqq 0.1$, acceptable distances d were observed to be between about 1 mm and 15 mm, with the best distances d between about 2 mm and 5 mm. This distance d has been determined by the inventors of the present invention to be large enough to minimize contact between the electrically conductive particles and the anode 104 while being small enough to minimize the resistance to ionic current flow. Thus, there is no physical separator separating the top of the pellet bed cathode from the anode 104, only the distance d. Without a physical separator, the aforementioned problems with separators discussed in the background of the invention, namely, separator erosion through contact with the moving particles and growth of dendritic particles that penetrate the separator and cause an electrical short between the anode and cathode, are eliminated. Gravity in conjunction with the inclined upper surface 122 of the cathode 102 inhibits contact between the electrically conductive particles and the anode 104. Even if occasional intermittent contact between a cathode particle and the anode occurs, it is of no consequence because the particle is rapidly swept away from the area by the bulk flow of the particle bed and no permanent short-circuit is created.

The feed reservoir 106 is located near the upper portion 124 of the cathode support 102. The feed reservoir 106 supplies the fluidized electrically conductive cathode particles to the inclined cathode support 102. The feed reservoir 106 includes a particle screening or filtering mechanism 136 adjacent to an electrolyte outlet 138 for filtering or screening out particles in the delivery of electrolyte to the electrolyte fluid tank 112 via the bleed line 114, and a feed control mechanism 140 for controlling the flow rate and density of the bed of electrically conductive particles flowing down the cathode 102. In a preferred embodiment of the invention, the feed control mechanism 140 includes an adjustable orifice plate that may be adjusted to control the size of a feeding aperture. The fluidized electrically conductive particles enter or are supplied to the upper portion 124 of the inclined cathode 102 at the feeding aperture defined by the feed control mechanism 140.

The receiving reservoir 108 is located near the lower portion 126 of the cathode 102 and receives the electrolyzed particles that flow down the inclined cathode 102. The recirculation line 110 communicates the receiving reservoir 108 with the feed reservoir 106 for recirculating electrolyzed particles for additional electrodeposition. The receiving reservoir 108 further includes an electrolyte inlet 142 in communication with the fluid supply line for the delivery of electrolyte from the electrolyte fluid tank 112. The receiving reservoir 108 may include an outlet (not shown) for removing electrolyzed particles from the electrolyzer 100.

One or more pumps such as pump 118 may be interconnected with one or more of the lines 110, 114, 116 for controlling the flow rate therethrough. Proper control of the flow rate through the lines 110, 114, 116 is important for controlling the flow rate and density of the bed of electrically conductive particles flowing down the cathode 102. In the exemplary embodiment of the electrolyzer 100 illustrated in FIG. 1, the flow rate through the recirculation line 110 is approximately 5–8 gallons per minute (gpm)., the flow rate of the bed of electrically conductive particles down the cathode 102 is approximately 0.5 gpm, the flow rate through the bleed line 114 and fluid supply line 116 is approximately 1 gpm or up to about 20% of the total.

Figure 5:
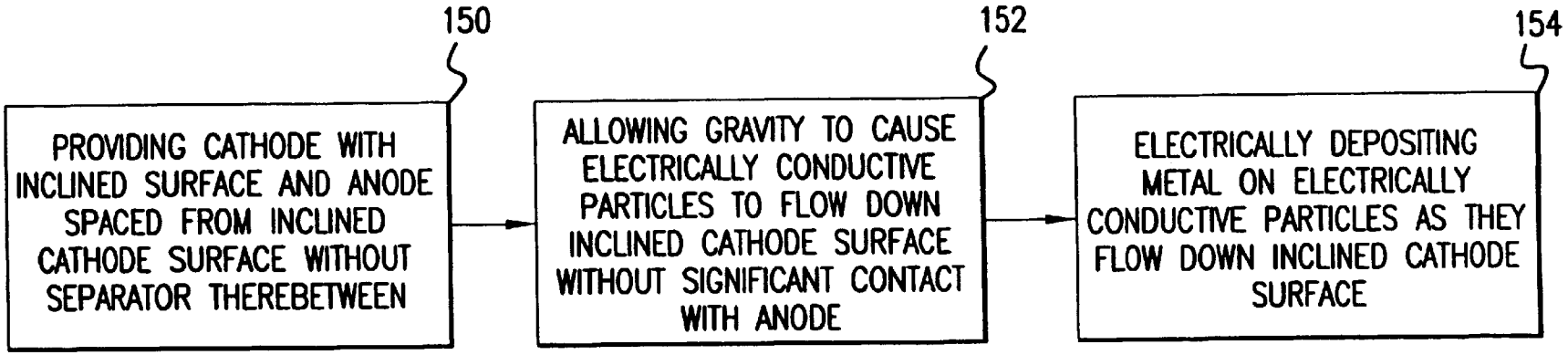
FIG. 5 is a flow chart illustrating a method of electrodepositing metal on electrically conductive particles according to an embodiment of the invention.

With reference to the flow chart of FIG. 5, one embodiment of a method of electrodepositing metal on electrically conductive particles using the electrolyzer 100 will first be described generically and then in more detail. The first step, which is identified in the flow chart with reference numeral 150, is to provide a cathode 102 having an inclined upper surface 122 and an anode 104 a spaced distance from the cathode 102 without a separator therebetween. Step 152, the next step, includes allowing gravitational forces to cause a bed of electrically conductive particles to flow at a substantially uniform density and flow rate down the inclined upper surface 122 of the cathode 102 without significant contact with the anode. Step 154, which typically occurs at the same time as step 152, includes electrodepositing metal on the electrically conductive particles as the particles flow down the inclined surface 122 of the cathode 102 by providing an electrical current between the cathode 102 and anode 104.

The method of electrodepositing metal on electrically conductive particles using the electrolyzer 100 will now be described in more detail. Before operation, the electrolyzer 100 may be filled with a liquid containing electrolyte and reaction product, e.g., potassium hydroxide and zinc oxide, some or all of which is in solution as potassium zincate, and the feed reservoir may be filled with zinc particles completely immersed in the liquid The zinc particles supplied to the feed reservoir 106 flow from the feed reservoir 106, through a feed orifice defined by the feed control mechanism 140, down the inclined cathode plate 120 and fall into the receiving reservoir 108 at the lower portion 126. The metal particles are then entrained in a jet of electrolyte supplied by the electrolyte fluid tank 112 via the fluid supply line 116 and transported to the feed reservoir 106 via the recirculation line 110. Thus, the particles undergo continuous circulation. In an alternative embodiment of the invention, the particles that have undergone electrolysis are removed from the receiving reservoir 108 and fresh zinc particles are supplied to the feed reservoir 106.

As the particles flow down the inclined cathode surface 122, under the influence of the applied electric field supplied by the power supply, zinc metal from the potassium zincate in the liquid deposits on the moving particles and oxygen is liberated on the anode mesh 130 and removed from the oxygen escape region 134. The movement of the particles is sufficient to prevent cementation of the particles that would otherwise occur if the bed of particles was stationary.

The flow rate of the particles and, hence, the thickness of the particle bed is controlled by the angle B of inclination of the cathode surface 122 and the rate of recirculation of the electrolyte through the recirculation line 110. The flow rate and the feed control mechanism 140 control the planarity of the top surface of the descending bed of particles.

The electrolyzer 100 is more reliable and compact than any other known form of electrolyzer intended for electrodeposition on metal particles. Its reliability derives from the simple manner of particle flow, where particle blocking or jamming is unlikely, and the controlled method of delivery through the feed aperture defined by the feed control mechanism 140. Another reason for the electrolyzer's reliability is the fact that it does not require a separator to prevent the metal particles from contacting the anode mesh 130. Gravity and the uniformity of the bed thickness maintain the separation between the mesh 130 and the metal particle bed. If a particle should contact the anode mesh 130 then the flow of the particle bed will break the contact and allow the particle to roll back into the descending flow. This form of electrolyzer can accommodate virtually any size particles providing that the particles have sufficient density to fall with the descending pellet flow. The ability to operate without a separator makes the electrolyzer 100 more reliable since a separator is subject to erosion and shorting due to the formation of dendrites, also a separator causes an increase in electrical resistance. Reduced operating costs are another benefit.

Another advantage is the compact size of the device since multiple electrolyzers 100 could be placed in a bipolar array and stacked one upon the other. To reduce the footprint of the electrolyzer 100, it could be arranged as a spiral or an array of electrolyzers 100 arranged as a double helix, providing a high space time yield.

Figure 3:
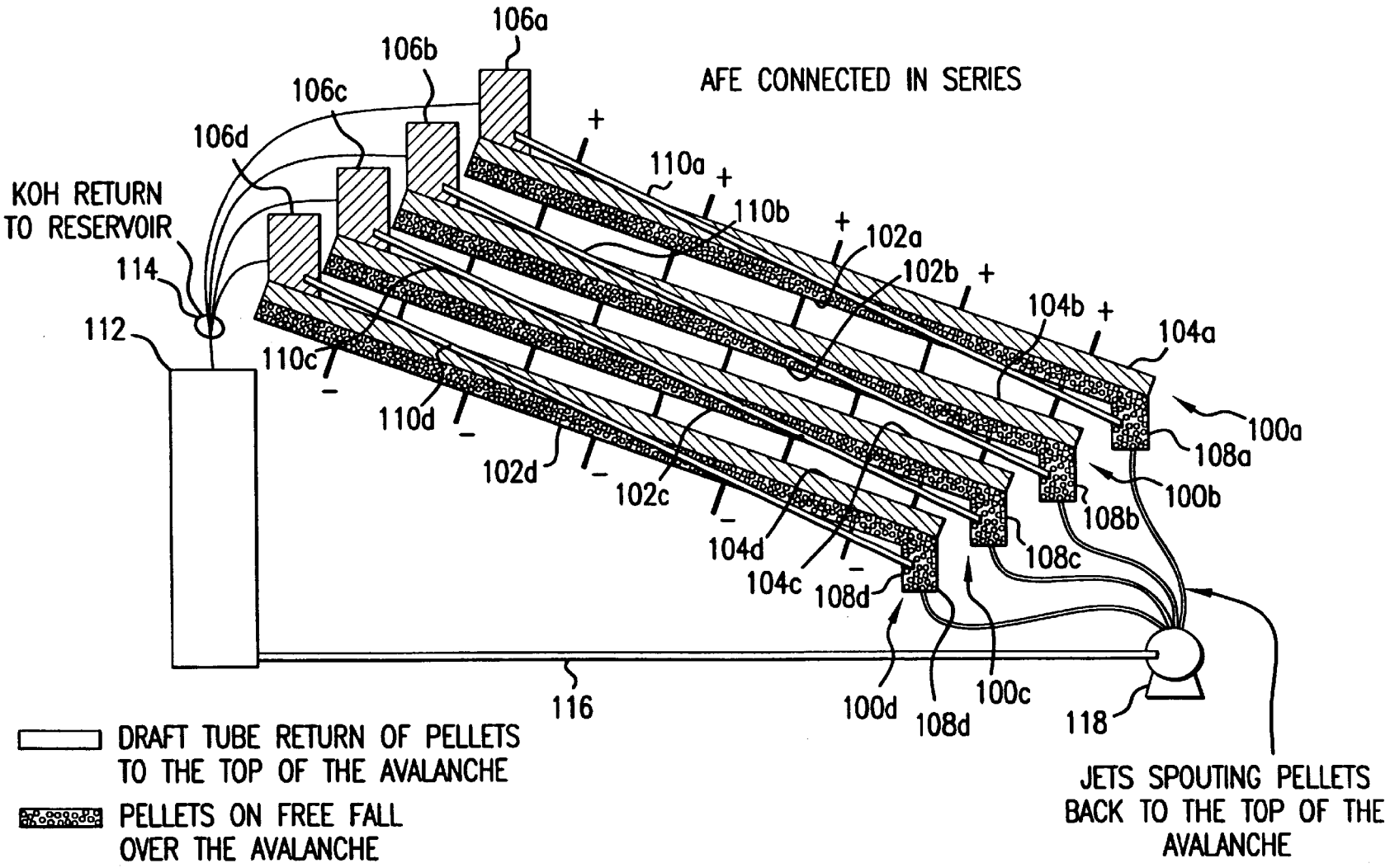
FIG. 3 is a schematic illustration of a multiplicity of electrolyzers connected in series for electrodeposition on electrically conductive particles.
Figure 6:
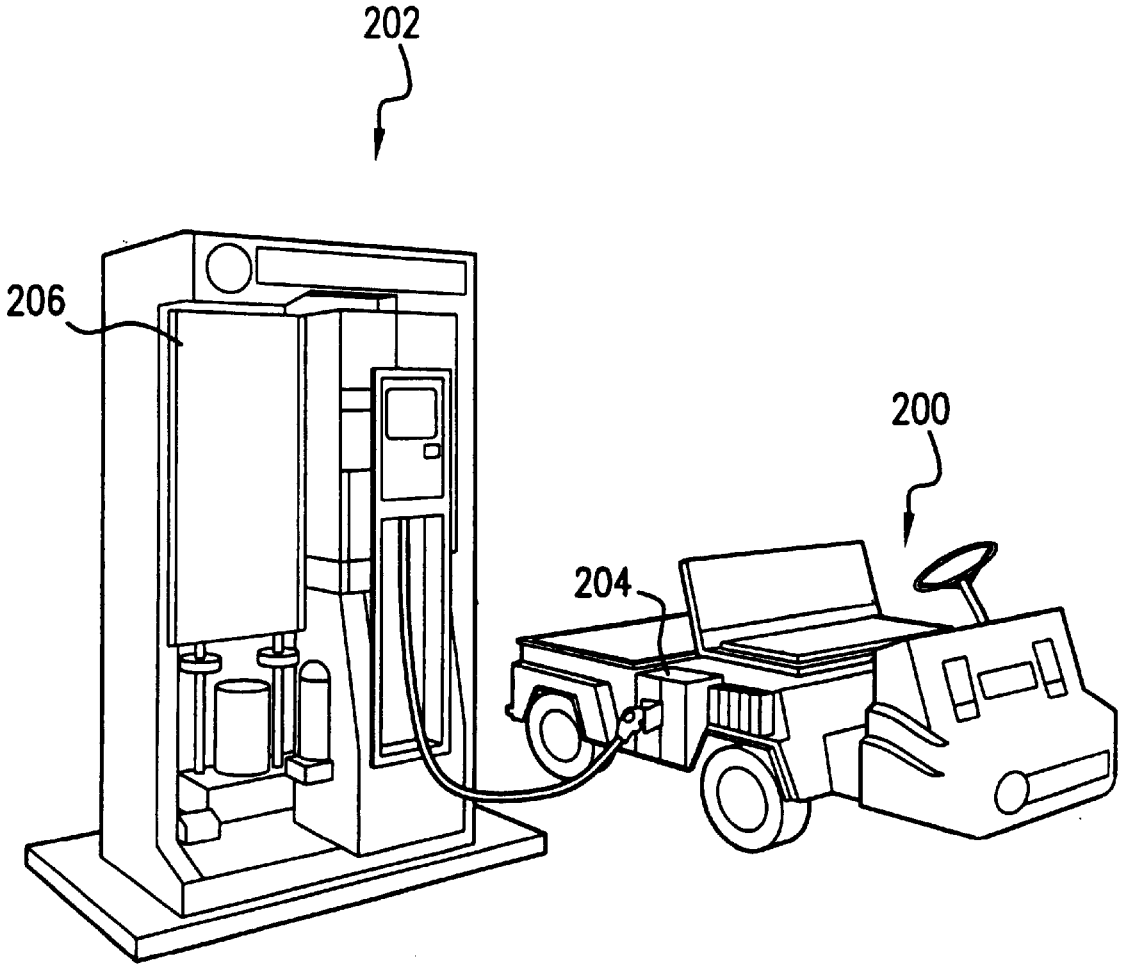
FIG. 6 is a perspective view of an embodiment of a recycling/refueling system in which the electrolyzer of the present invention may be used, along with an industrial electrical cart that may be powered by a metal/air fuel cell stack fueled with metal particles produced by the electrolyzer.

With reference to FIG. 6, an exemplary application for the electrolyzer 100 will now be described. FIG. 3 illustrates an industrial electrical cart 200 and a recycling/refueling system 202. The industrial electrical cart 200 may be equipped with a zinc/air fuel cell stack 204 for powering the cart 200. An industrial cart 200 is one of numerous portable electrically powered devices that a metal/air fuel cell system such as the zinc/air fuel cell stack 204 may be used to power. Other examples include, without limitation, lift trucks, floor sweepers and scrubbers, and commercial lawn and garden equipment.

The zinc/air fuel cell stack 204 includes multiple, stacked zinc/air fuel cells that utilize zinc pellets as fuel in an electrochemical reaction to produce electricity to drive the cart 200. This reaction also yields potassium zincate as a reaction product.

The zinc/air fuel cell stack 204 of the industrial electrical cart 200 may be refilled at the recycling/refueling system 202. During refueling, the spent zinc, i.e., potassium zincate, is transferred to the zinc recycling/refueling system 202. The recycling/refueling system 202 may include an electrodeposition system 206 including one or more of the above-described electrolyzers 100 for performing electrolysis to convert the potassium zincate to zinc metal in pellet form in the manner described above. The resulting zinc pellets are stored in a tank in the recycling/refueling system 202, and, when required, are pumped in a stream of flowing electrolyte into a fuel tank, hopper or other storage area of the zinc/air fuel cell stack 204 of the industrial electrical cart 200. Simultaneously, the potassium zincate is removed from the zinc/air fuel cell stack 204, also in a stream of flowing electrolyte, and transferred to the recycling/refueling system 202.

Alternately, in a cartridge-oriented system, zinc pellets in electrolyte are stored in a removable cartridge maintained in electrical cart 200. When the zinc pellets are exhausted, the empty cartridge may be replaced with a full cartridge obtained from recycling/refueling system 202. The empty cartridge may be placed within recycling/refueling system 202 for refilling.

Figure 2:
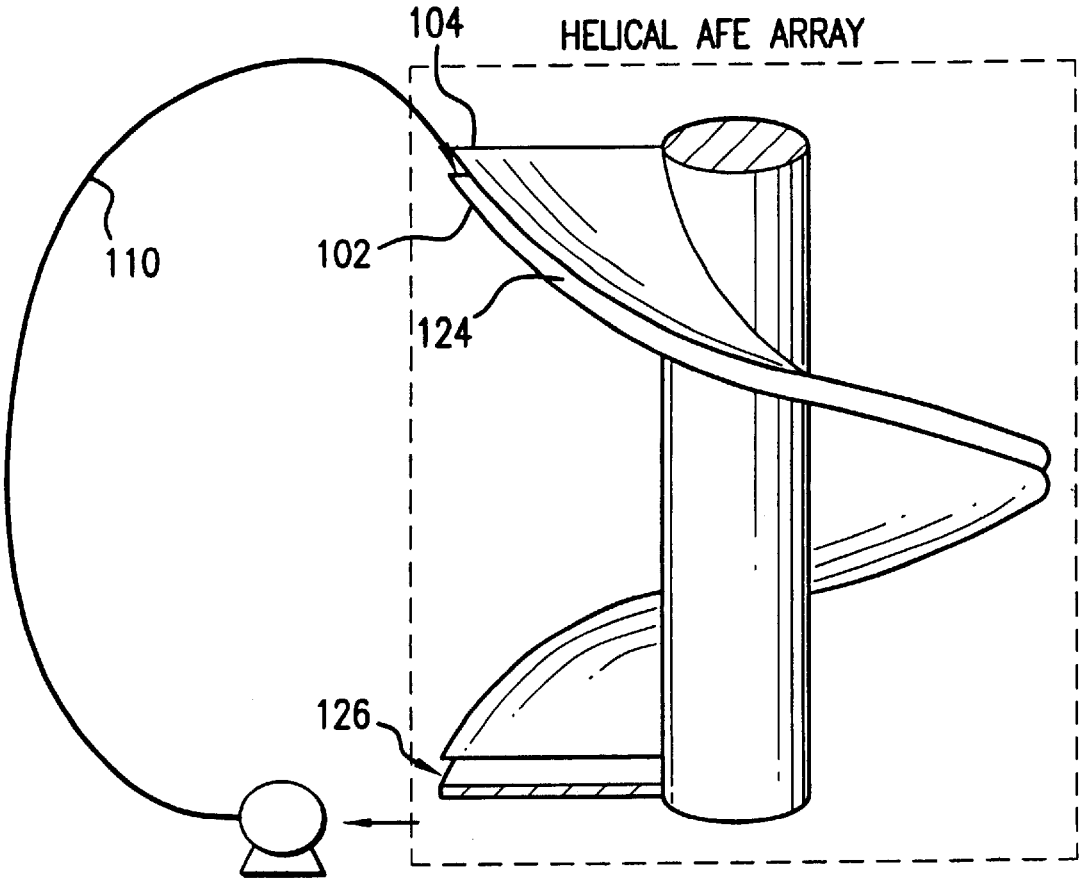
FIG. 2 is a schematic illustration of an alternative embodiment of an electrolyzer for electrodeposition on electrically conductive particles incorporating a helical cathode support.

A second embodiment of an electrolyzer in accordance with the subject invention is illustrated in FIG. 2 in which, compared to FIG. 1, like elements are referenced with like identifying numerals. As shown, in this embodiment, a helically-shaped cathode support 102 is provided. The cathode support 102 is spaced from helically-shaped anode 104 as in the previous embodiment, particles are deposited on an upper portion 124 of the cathode support 102, and then flow, through the action of gravity, down the surface of the cathode support 102. When the particles reach the lower portion 126 of the cathode support, they are directed back to the top portion 124 of the cathode support 102 through the action of the recirculation line 110.

A first embodiment of an electrolyzer system in accordance with the subject invention is illustrated in FIG. 3 in which, compared to FIG. 1, like elements are referenced with like identifying numerals. As shown, in this embodiment, a plurality of individual electrolyzers 100*a*, 100*b*, 100*c*, 100*d* configured in accordance with the subject invention are connected in series. The cathodes are these electrolyzers are identified respectively with numerals 102*a*, 102*b*, 102*c*, 102*d*, and the anodes thereof are identified respectively with numerals 104*a*, 104*b*, 104*c*, and 104*d*. The feed reservoirs for each of the electrolyzers are identified respectively with numerals 106*a*, 106*b*, 106*c*, and 106*d*, and the receiving reservoirs thereof are identified respectively with numerals 108*a*, 108*b*, 108*c*, and 108*d*. The recirculation lines for each of the electrolyzers are identified respectively with numerals 110*a*, 110*b*, 110*c*, and 110*d*.

In this system, particles flow down each of the cathode supports 102*a*, 102*b*, 102*c*, 102*d*, and are deposited into the respective receiving reservoirs 108*a*, 108*b*, 108*c*, and 108*d*. Pump 118 provides to each of the receiving reservoirs electrolyte from reservoir 112, thereby delivering the particles back to feed reservoirs 106*a*, 106*b*, 106*c*, 106*d*, respectively. Excess electrolyte from the feed reservoirs 106*a*, 106*b*, 106*c*, and 106*d* is provide back to reservoir 112 through bleed lines 114.

Figure 4:
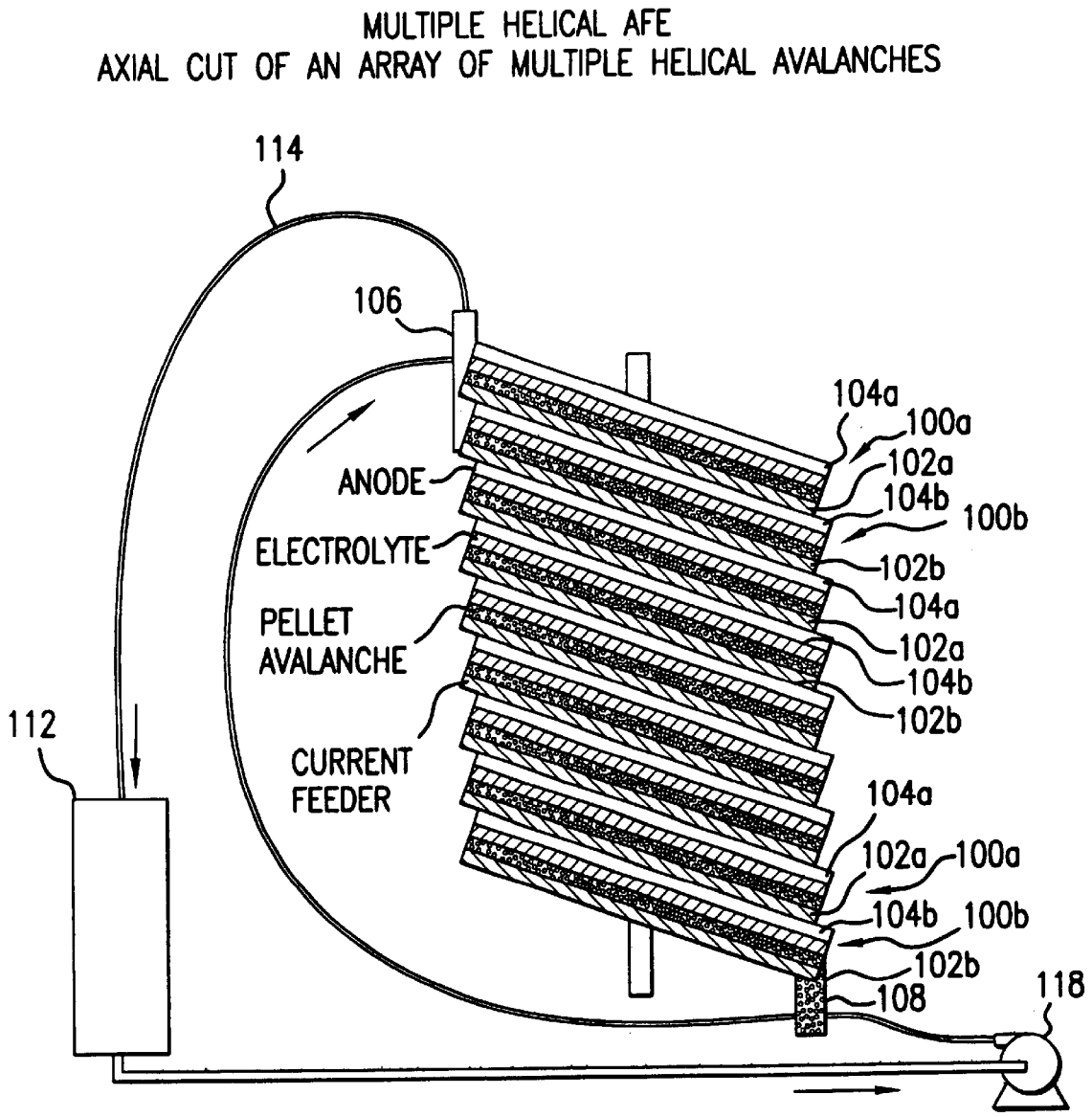
FIG. 4 is a schematic illustration of a multiplicity of helically-shaped electrolyzers connected in series for electrodeposition on electrically conductive particles incorporating helical cathode supports.

A second embodiment of an electrolyzer system in accordance with the subject invention is illustrated in FIG. 4 in which, compared to FIG. 1, like elements are referenced with like identifying numerals. In this system, a plurality 100*a*, 100*b* of helically-shaped electrolyzers are connected in series. The cathodes for the electrolyzers are respectively identified with numerals 102*a*, 102*b*, and the anodes thereof are respectively identified with numerals 104*a*, 104*b*. The feed reservoir for the electrolyzers is identified with numeral 106, and the receiving reservoir for the electrolyzers is identified with numeral 108.

Figure 7:
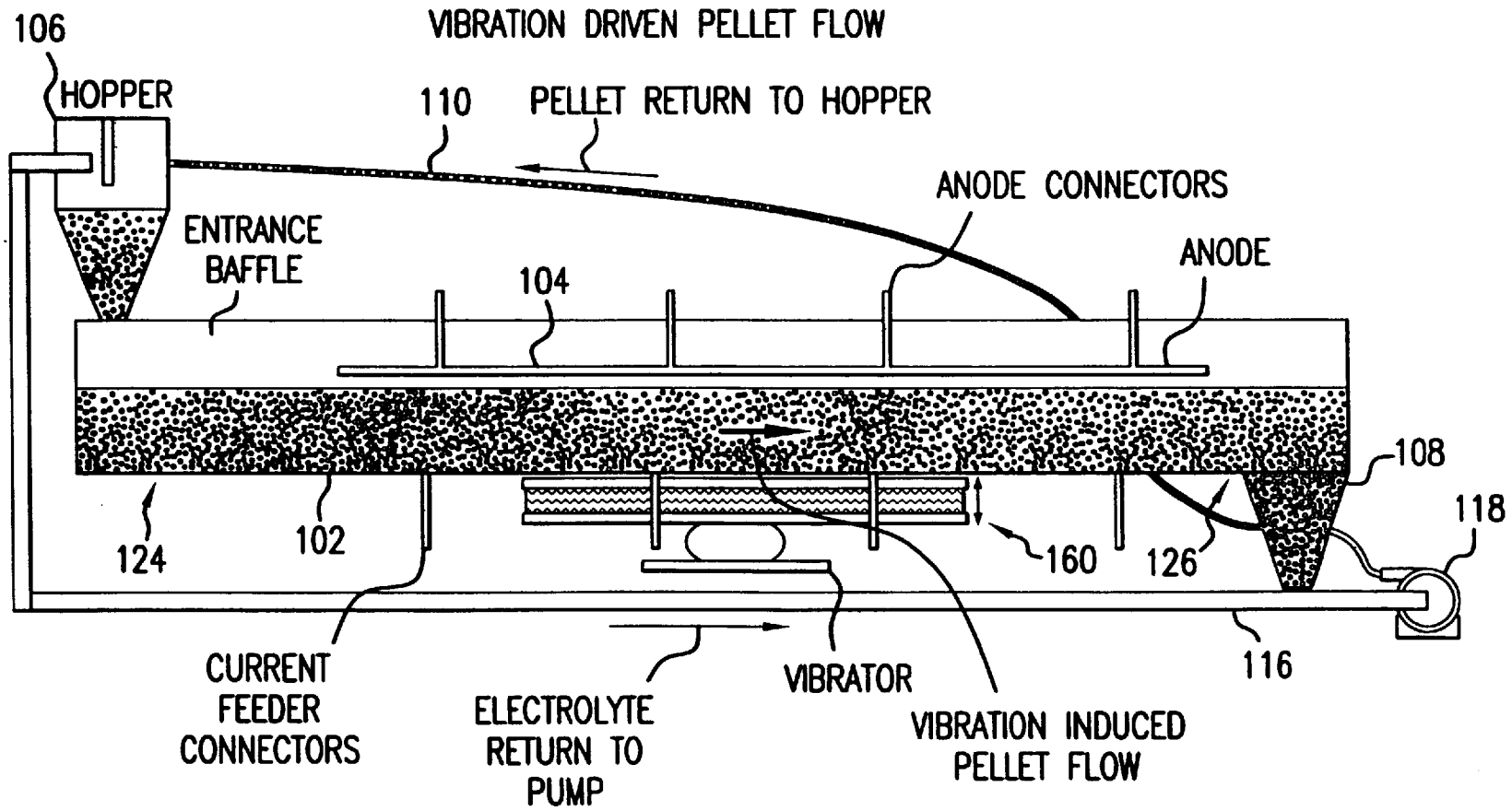
FIG. 7 illustrates an embodiment of the invention in which the cathode support comprises a rotating funnel-shaped element, and a centrifugal force causes an upward flow of particles along the surface of the cathode support.

A third embodiment of an electrolyzer in accordance with the subject invention is illustrated in FIG. 7 in which, relative to FIG. 1, like elements are referenced with like identifying numerals. Cathode support 102 in this embodiment is vibrated by vibrator 160. In one implementation, the support is caused to vibrate in such a way (for example, in a clockwise motion) so as to induce particles on the cathode surface to move to the right. In another implementation, the support is caused to vibrate in such as way (for example, in a counterclockwise motion) so as to induce the particles on the cathode surface to move to the left. In this embodiment, it is the frictional force between the cathode support surface and the particles that induces the movement of the particle bed. Some of this force may be transferred through the electrolyte.

In this embodiment, particles are provided from feed reservoir 106 to portion 124 of the cathode support 102. The particles are then caused to move to the right across the surface of the cathode support through the action of the frictional force induced by vibrator 160. When the particles reach the portion 126 of the cathode surface 102, they are collected by receiving reservoir 108.

Pump 118 directs electrolyte to the particles in receiving reservoir 108, causing the particles to flow through recirculation line 110 back to the feed reservoir 106.

Figure 8:
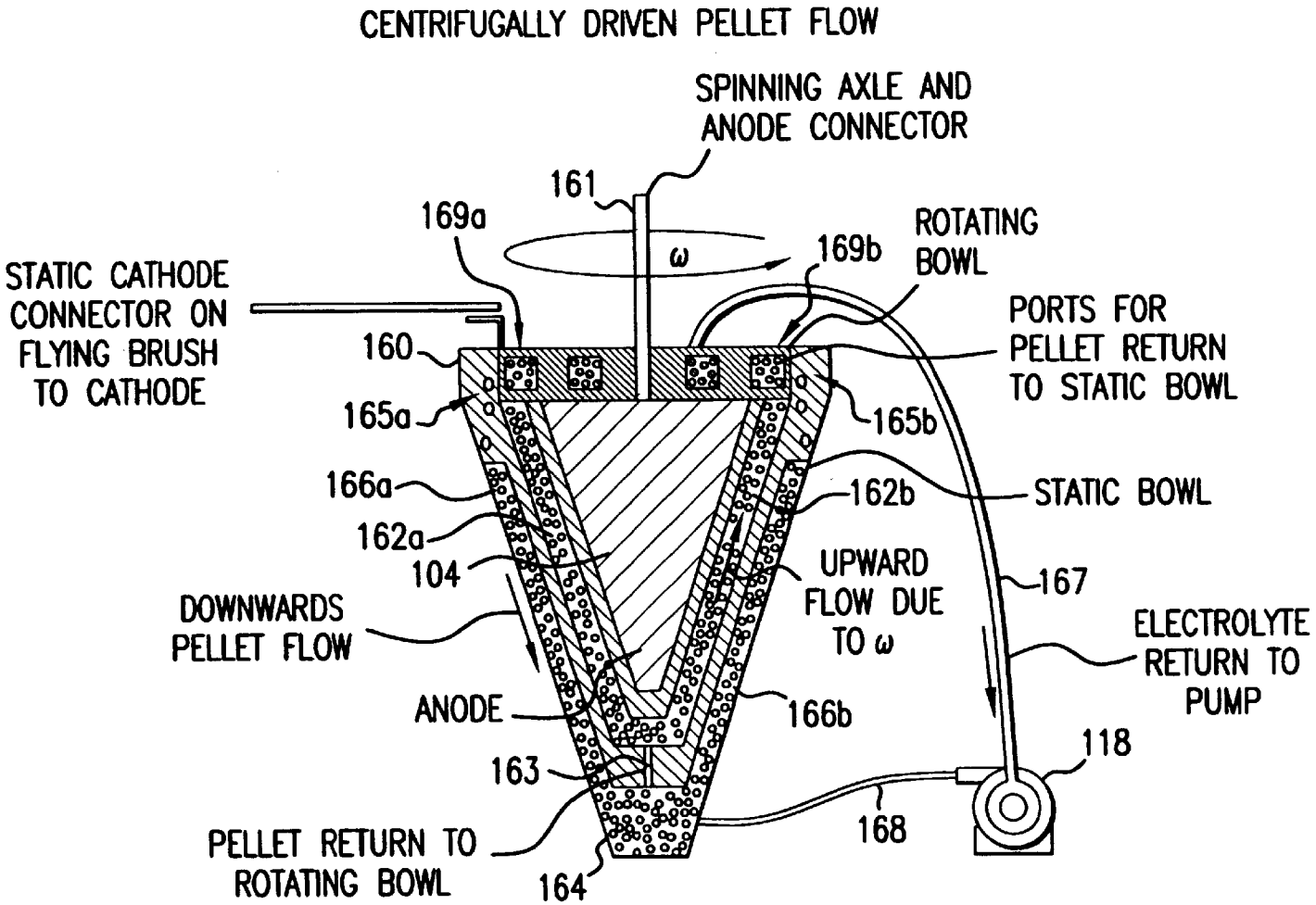
FIG. 8 illustrates an embodiment of the invention in which the cathode support comprises a vibrating surface, and a frictional force causes particles to flow across the surface of the cathode support.

A fourth embodiment of an electrolyzer in accordance with the subject invention is illustrated in FIG. 8 in which, relative to FIG. 1, like elements are referenced with like identifying numerals.

In this embodiment, a generally funnel-shaped element 160 rotates in a counterclockwise direction around axis 161, although it should be appreciated that embodiments are possible in which the direction of rotation is reversed or that rotating elements of a different shape may be used.

The centrifugal force which arises from the rotation of element 190 causes the particles to flow upwards over paths 162*a* and 162*b* to receiving areas 169*a* and 169*b*, whereupon the particles flow downwards through paths 166*a* and 166*b* to collections area 164. Pump 118 pumps electrolyte over lines 167 and 168 to collections area 164, causing the particles therein to flow through particle return hole 163. At this point, the particles begin again the process of flowing upwards over paths 162*a* and 162*b* through the action of centrifugal force.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of electrodepositing metal on electrically conductive particles, comprising:

allowing a force to cause a bed of electrically conductive particles to flow across a particle contacting surface of a cathode support spaced from an anode, wherein the force has a direction and the particle contacting surface is at an angle between about 15 and 85° relative to the direction of the force;

avoiding sustained contact between the particles and the anode without use of a separator; and providing an electrical current between the bed of particles and the anode, thereby electrodepositing metal on said electrically conductive particles as they flow across the particle contacting surface of the cathode support.

2. The method of claim 1 wherein said particle contacting surface is an inclined plane, and the particles are caused to move down the plane through the force of gravity.

3. The method of claim 2, wherein said particle contacting surface has first and second portions, the method further including recirculating electrically conductive particles from said second portion of the particle contacting surface to said first portion of the particle contacting surface using a pump.

4. The method of claim 1 wherein said particle contacting surface is a helical or spiral surface, and the particles are caused to move down the surface through the force of gravity.

5. The method of claim 1 wherein said particle contacting surface is a vibrating surface, and the particles are caused to move across the surface through a frictional force caused by the vibration.

6. The method of claim 1 further comprising removing oxygen produced during electrodeposition from an oxygen escape region located between said anode and a current collector supporting said anode.

7. The method of claim 1, further comprising controlling the flow rate and density of said electrically conductive particles flowing across the particle contacting surface of said cathode support.

8. The method of claim 1, further comprising supplying the electrolyzer with electrically conductive particles and an electrolyte containing metal ions.

9. The method of claim 1, further comprising receiving said electrically conductive particles after they flow across the particle contacting surface of said cathode support.

10. The method of claim 1, further comprising recirculating electrically conductive particles from a lower portion of the cathode support to an upper portion of the cathode support.

11. The method of claim 1, further comprising bleeding a portion of fluid supplied to a feed reservoir to a fluid tank using a fluid bleed line.

12. The method of claim 1, further comprising supplying additional fluid to a receiving reservoir using a fluid supply line.

13. The method of claim 1 wherein the angle of the particle contacting surface is between about 45 and 80° relative to the direction of the force.

14. The method of claim 13 wherein the angle of the particle contacting surface is between about 65 and 70° relative to the direction of the force.

15. The method of claim 1 wherein said particles have an average diameter, and said bed has an upper surface spaced a distance from the anode which distance is between about 1 to 50 times the average diameter of the particles.

16. The method of claim 15 wherein said distance is between about 1 to 10 times the average diameter of the particles.

17. The method of claim 1 wherein said particles flowing across said particle contacting surface form a bed having an upper surface spaced a distance from the anode, and said distance is between about 1 and 15 mm.

18. The method of claim 17 wherein said distance is between about 2 and 5 mm.

19. A method of electrodepositing metal on electrically conductive particles, comprising:

allowing a force to cause a bed of electrically conductive particles to flow across a particle contacting surface of a cathode support spaced from an anode;

avoiding sustained contact between the particles and the anode; and providing an electrical current between the bed of particles and the anode, thereby electrodepositing metal on said electrically conductive particles as they flow across the particle contacting surface of the cathode support;

wherein said particle contacting surface is an inner surface of a rotating generally funnel-shaped element, and the particles are caused to move upwards along the surface through a centrifugal force.

20. A method of electrodepositing metal on electrically conductive particles, comprising:

allowing a force to cause a bed of electrically conductive particles to flow across a particle contacting surface of a cathode support spaced from an anode;

avoiding sustained contact between the particles and the anode; and providing an electrical current between the bed of particles and the anode, thereby electrodepositing metal on said electrically conductive particles as they flow across the particle contacting surface of the cathode support;

wherein said particle contacting surface is an upper surface of a rotating generally disk-shaped element, and the particles are caused to move outwards along the surface through a centrifugal force.

21. A method of electrodepositing metal on electrically conductive particles, comprising:

allowing a gravitational force to cause a bed of electrically conductive particles to flow across a particle contacting surface of a cathode support spaced from an anode;

avoiding sustained contact between the particles and the anode without use of a separator; and providing an electrical current between the bed of particles and the anode, thereby electrodepositing metal on said electrically conductive particles as they flow across the particle contacting surface of the cathode support.

22. The method of claim 21 wherein the gravitational force has a direction and the particle contacting surface is at an angle between about 45 and 80° relative to the direction of the force.

23. A method of electrodepositing metal on electrically conductive particles, comprising:

allowing a force to cause a bed of electrically conductive particles to flow across a particle contacting surface of a cathode support spaced from an anode;

avoiding sustained contact between the particles and the anode without use of a separator; and providing an electrical current between the bed of particles and the anode, thereby electrodepositing metal on said electrically conductive particles as they flow across the particle contacting surface of the cathode support;

wherein said particles have an average diameter, and said bed has an upper surface spaced a distance from the anode which distance is between about 1 to 50 times the average diameter of the particles.

24. The method of claim 23 wherein said distance is between about 1 to 10 times the average diameter of the particles.

25. A method of electrodepositing metal on electrically conductive particles, comprising:

allowing a force to cause a bed of electrically conductive particles to flow across a particle contacting surface of a cathode support spaced from an anode;

avoiding sustained contact between the particles and the anode without use of a separator; and providing an electrical current between the bed of particles and the anode, thereby electrodepositing metal on said electrically conductive particles as they flow across the particle contacting surface of the cathode support;

wherein said bed has an upper surface spaced a distance from the anode which distance is between about 1 and 15 mm.

26. The method of claim 25 wherein said distance is between about 2 and 5 mm.

27. A method of electrodepositing metal on electrically conductive particles, comprising:

allowing a force to cause a bed of electrically conductive particles to flow across a particle contacting surface of a cathode support spaced from an anode;

avoiding sustained contact between the particles and the anode without use of a separator; and providing an electrical current between the bed of particles and the anode, thereby electrodepositing metal on said electrically conductive particles as they flow across the particle contacting surface of the cathode support;

wherein said particle contacting surface has a roughness parameter of between about 0 and 10.

28. The method of claim 27 wherein said roughness parameter is between about 0 and 0.1.

29. A method of electrodepositing metal on electrically conductive particles, comprising:

allowing a force to cause a bed of electrically conductive particles to flow across a particle contacting surface of a cathode support spaced from an anode, wherein the force has a direction and the particle contacting surface is at an angle between about 15 and 85° relative to the direction of the force;

avoiding sustained contact between the particles and the anode without use of a separator; and providing an electrical current between the bed of particles and the anode, thereby electrodepositing metal on said electrically conductive particles as they flow across the particle contacting surface of the cathode support;

wherein said particles have an average diameter, and said bed has an upper surface spaced a distance from the anode which distance is between about 1 to 50 times the average diameter of the particles; and wherein said particle contacting surface has a roughness parameter of between about 0 and 10.

30. A method of electrodepositing metal on electrically conductive particles, comprising:

allowing a force to cause a bed of electrically conductive particles to flow across a particle contacting surface of a cathode support spaced from an anode, wherein the particle contacting surface is at an angle between about 5 and 75° relative to horizontal;

avoiding sustained contact between the particles and the anode without use of a separator; and providing an electrical current between the bed of particles and the anode, thereby electrodepositing metal on said electrically conductive particles as they flow across the particle contacting surface of the cathode support.

31. The method of claim 30 wherein the angle of the particle contacting surface is between about 10 and 45° relative to horizontal.

32. The method of claim 31 wherein the angle of the particle contacting surface is between about 20 and 25° relative to horizontal.

33. A method of electrodepositing metal on electrically conductive particles, comprising:

a step for allowing a force to cause a bed of electrically conductive particles to flow across a particle contacting surface of a cathode support spaced from an anode, wherein the force has a direction and the particle contacting surface is at an angle between about 15 and 85° relative to the direction of the force;

a step for avoiding sustained contact between the particles and the anode without use of a separator; and a step for providing an electrical current between the bed of particles and the anode, thereby electrodepositing metal on said electrically conductive particles as they flow across the particle contacting surface of the cathode support.

34. A method of electrodepositing metal on electrically conductive particles, comprising:

a step for allowing a force to cause a bed of electrically conductive particles to flow across a particle contacting surface of a cathode support spaced from an anode, wherein the particle contacting surface is at an angle between about 5 and 75° relative to horizontal;

a step for avoiding sustained contact between the particles and the anode without use of a separator; and a step for providing an electrical current between the bed of particles and the anode, thereby electrodepositing metal on said electrically conductive particles as they flow across the particle contacting surface of the cathode support.

* * * * *